US007000549B2

(12) United States Patent
Nelson

(10) Patent No.: US 7,000,549 B2
(45) Date of Patent: Feb. 21, 2006

(54) CORRUGATED PALLET

(76) Inventor: Duane Nelson, 237 Creekridge Dr., Spartanburg, SC (US) 29301

( * ) Notice: Subject to any disclaimer, the term of this patent is extended or adjusted under 35 U.S.C. 154(b) by 11 days.

(21) Appl. No.: 10/838,921

(22) Filed: May 4, 2004

(65) Prior Publication Data

US 2005/0247240 A1 Nov. 10, 2005

(51) Int. Cl.
*B65D 19/00* (2006.01)

(52) U.S. Cl. ..... 108/51.3

(58) Field of Classification Search ..... 108/51.3, 108/51.11, 56.1, 56.3
See application file for complete search history.

(56) References Cited

U.S. PATENT DOCUMENTS 2,709,559 A * 5/1955 Geisler ..... 108/51.3
2,908,464 A * 10/1959 Traudt et al. ..... 108/51.3
3,131,656 A * 5/1964 Houle ..... 108/51.3
4,936,229 A * 6/1990 Parnell ..... 108/51.3
4,979,446 A 12/1990 Winebarger
5,129,329 A * 7/1992 Clasen ..... 108/51.3
5,184,558 A 2/1993 Wozniacki
5,357,875 A 10/1994 Winebarger et al.
5,469,795 A 11/1995 Moorman
5,487,345 A 1/1996 Winebarger et al.
5,568,774 A 10/1996 Hutchison
5,784,971 A * 7/1998 Chang ..... 108/51.3
6,079,337 A * 6/2000 Huang et al. ..... 108/56.3
6,155,181 A * 12/2000 Chilcutt ..... 108/51.3
6,612,247 B1 9/2003 Pistner et al.
6,739,270 B1 * 5/2004 Sewell ..... 108/51.3

FOREIGN PATENT DOCUMENTS

EP 598540 A1 * 5/1994

* cited by examiner

*Primary Examiner*—Jose V. Chen
(74) *Attorney, Agent, or Firm*—J. Herbert O'Toole; Nexsen Pruet, LLC

(57) ABSTRACT

A shipping pallet compatible with fork-lifts and pallet-trucks is made from stamped or die cut flat corrugated board. Stringer and cross-braces from an interlocking grid work to which a top and bottom flat sheet are attached by an adhesive. The pallet may be recycled as paper and not returned to the sender. Additional reinforcement structures may be added for heavier loads.

6 Claims, 11 Drawing Sheets

CORRUGATED PALLET

FIELD OF THE INVENTION

This invention relates to high strength recyclable corrugated pallets.

BACKGROUND AND PRIOR ART

Corrugated paper dates to the mid-19$^{th}$ century and corrugated paper for shipping pallets dates to the early 1970's in Japan. Most are based upon multiplying folded corrugated sheets to approximate the wooden stringers of conventional pallets. Wozniacki, U.S. Pat. No. 5,184,558 and Hutchison, U.S. Pat. No. 5,568,774 are representative. Such construction is suitable for most pallets used for shipping consumer items but is difficult to assemble without expensive automation and also difficult to ship in knock-down form.

Corrugated pallets have many advantages. Unlike wooden, plastic, or metal pallets, corrugated can be recycled at the recipient's location as paper/card board and does not have to be returned for reuse. Even so called "pallet pools" ship a lot of air.

Exported pallets pose two problems. Return is nearly impossible and the International Plant Protection Convention, as well as local laws in the EU, China and Australia effectively implement a ban on wood pallets which have not been certified to be fumigated by heat or pressure treatment with chemicals. Corrugated pallets, because of their processing, do not require fumigation and offer clear cost advantages in foreign shipping.

There exists a need for simple corrugated pallet designs which are strong but do not require expensive multiple-step die cutting and folding steps, do not require excessive adhesive to assemble and which can be assembled at the user's site by minimally skilled laborers.

BRIEF DESCRIPTION OF THE INVENTION

It is a first object of this invention to provide a rigid corrugated pallet for shipping and handling materials.

It is a second object of this invention to provide a corrugated pallet which can be shipped to the user in knock-down form. It is a third object of the invention to provide components for a corrugated container which require a minimal investment by manufacturers.

It is a fourth object of this invention to provide a corrugated pallet which is compatible with both fork lifts and pallet trucks. A fifth object of this invention is a corrugated pallet which is reinforced to allow stack heights equivalent to that obtained with wood and plastic pallets conventionally in use.

These and other objects may be obtained by forming a corrugated pallet using a single die cut sheet of corrugated for each stringer; a single die cut corrugated sheet for cross-bracing; and two flat corrugated sheets for the top and bottom faces. Additional sheets may be added to interdigitate with the basic stringers and cross-braces to increase load bearing capacity for heavier cases and higher stackings.

DETAILED DESCRIPTION OF THE INVENTION

An easily assembled, light weight recyclable corrugated pallet can be assembled from three stampings. The size of each stamping would change with the size of the pallet, typically in full, half and quarter-pallet sizes, based on a common 40"×48" standard (nominally 1.0×1.2m). In most circumstances, industry standard single wall (double face) corrugated board may be used although double wall and tri-wall board is readily available and suitable for heavier use. It is critical that the board be cut so that the flutes in the walls are arranged in the upright or vertical orientation in both the stringers and cross-braces when viewed in the plan-view of the deck.

The type and amount of adhesive and the paper quality of the cardboard depend upon intended use. Maritime transport calls for wet strength paper and water-resistant glue. Glue guns are most convenient for applying adhesive but brushes and rollers are suitable.

Figure 1:
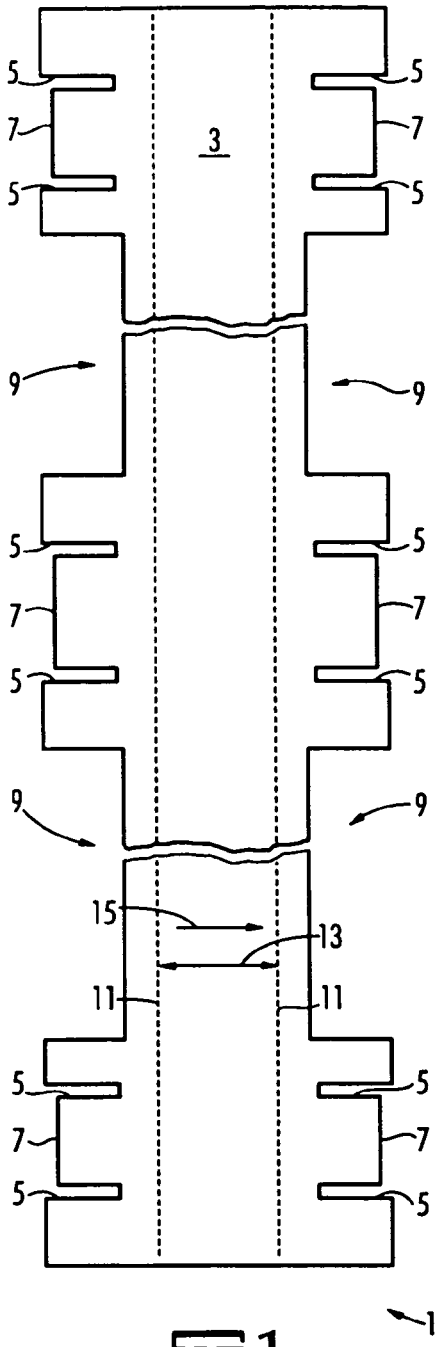
FIG. 1 shows a stamped flat cross-brace for a corrugated pallet.
Figure 2:
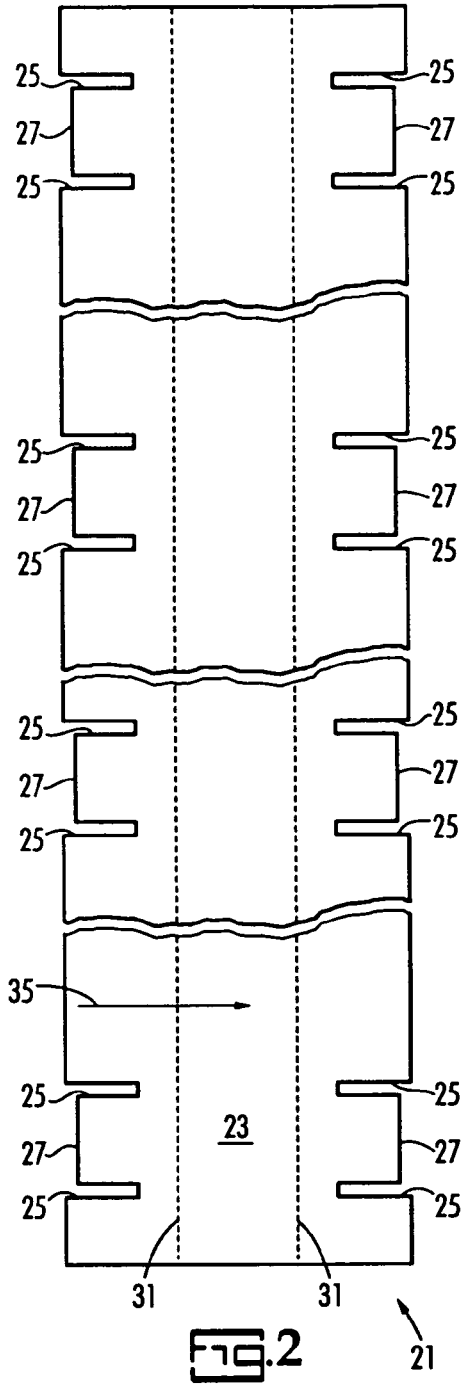
FIG. 2 shows a stamped flat stringer for a corrugated pallet.

FIG. 1 shows the standard pattern for a cross-brace 1. The blank 3, the length of which conforms to the short side of the pallet face, is stamped to provide cut-outs 5 to receive the walls of the stringers. Between the cut-outs, the width of the blank is reduced at 7 to avoid interference with the stringer.

Cut outs 9 are cut from the width of the blank to fold lines 11. When the blank is folded along the fold lines, the distance 13 between the fold lines 11 becomes the width of the cross-brace.

The flute direction is indicated by arrow 15. The cut outs 9, where the blank is folded along the fold line, form the cut out for the tines of a fork lift or pallet truck.

Stringer 21 is formed from a blank 23, the length of which conforms to that of the long side of the finished pallet. Cut outs 25 are arranged to interdigitate with the cross-braces and the space 27 between cut outs 25 are relieved to mesh with the cross-braces. Fold lines 31 are formed so that the blank may be folded to form a rectangular stringer. The flute direction is indicated by arrow 35.

Figure 3:
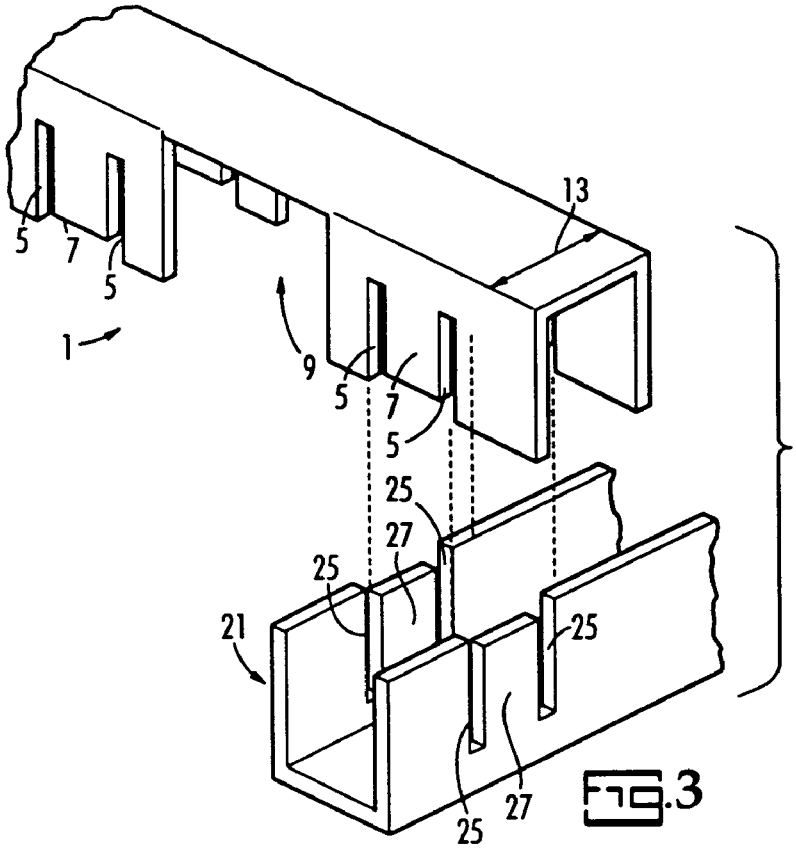
FIG. 3 is an exploded view showing how the stringers and cross-braces interlock.

When the cross-braces 2 and stringers 21 are folded along their respective fold lines and assembled as indicated in FIG. 3, a rectilinear gridwork is formed. Adhesive is then applied to the outer surfaces between the respective fold lines and flat corrugated panels applied to the adhesive. Preferably, adhesive is also applied to points of contact between cross-braces and stingers.

Figure 4:
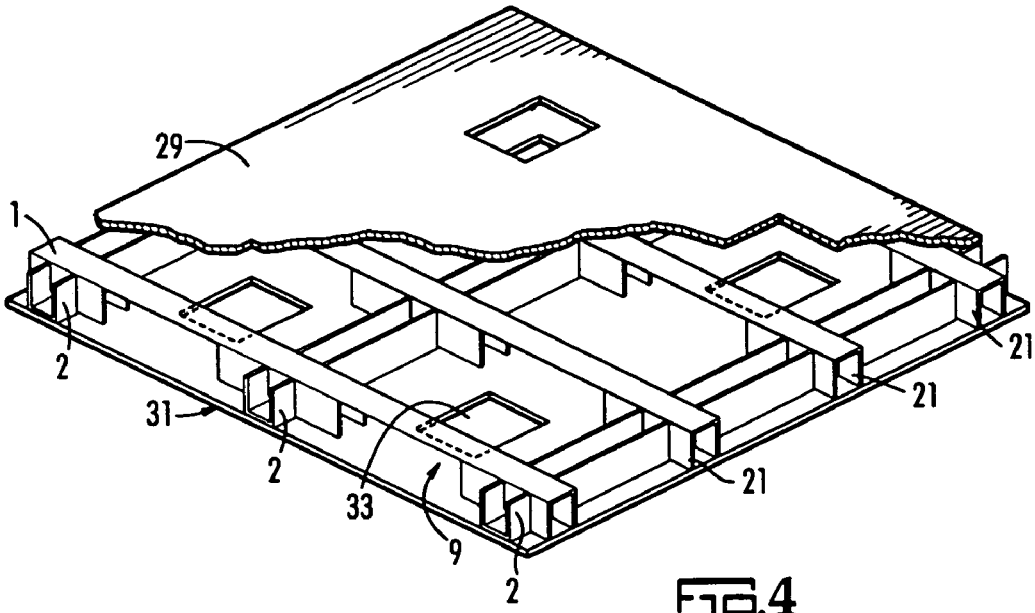
FIG. 4 is a partial cut-away of a completed corrugated pallet.

When the flat panels 29 and 31 have been adhered to the grid work, the result is that illustrated in FIG. 4. It is noted that the cut-outs 9, aligned, provide openings for entry of tines of a fork lift or other fork-based warehouse handling systems. Additional cut-out 33 may be present to accommodate load wheels of a pallet truck.

The pallets may be printed with a bar code or an RFID may be used to assist in tracking in a plant, warehouse or loading dock.

Figure 5:
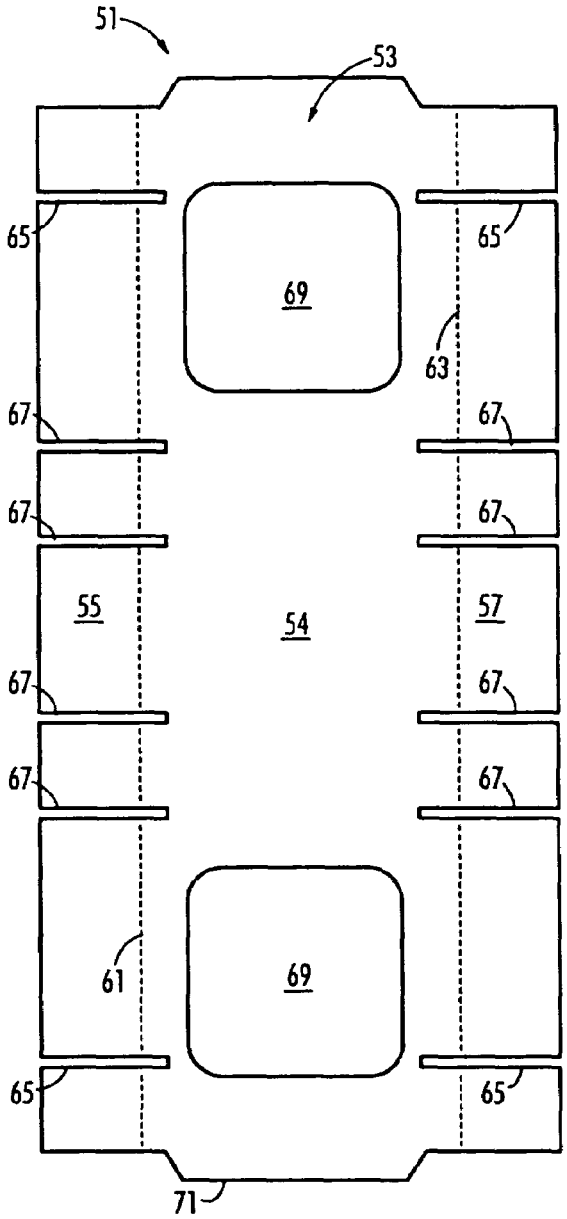
FIG. 5 is a stamped base support for a pallet with cut-outs for the wheels of a pallet truck.

For heavier loads or high stack heights, additional stampings may be incorporated into the basic structure. FIG. 5. illustrates a reinforcement section 51 formed from a blank 53 which has been cut-out to form three sections 54, 55 and 57, separated by creases 61, 63. When folded at the creases, the width of section 53, together with the thickness of sections 55, 57, fits the space between stringers. Cut-outs 65 align with the end cross-brace 1, the cutouts 67 align with interior sections of cross-braces. An optional pair of open rectangular area 69 are available to receive the load wheels of a pallet truck. The ends 71 are cut to the full length of the pallet in section 54, but shorter in sections 55, 57 to accommodate the stringers.

A second reinforcing section 81 is formed from a blank 83 and notched at the sides at 85 in the same pattern as in FIG. 5. The ends 87 are cut to be the full length of the pallet while accommodating the junction of stringer and cross-bracing.

Figure 6:
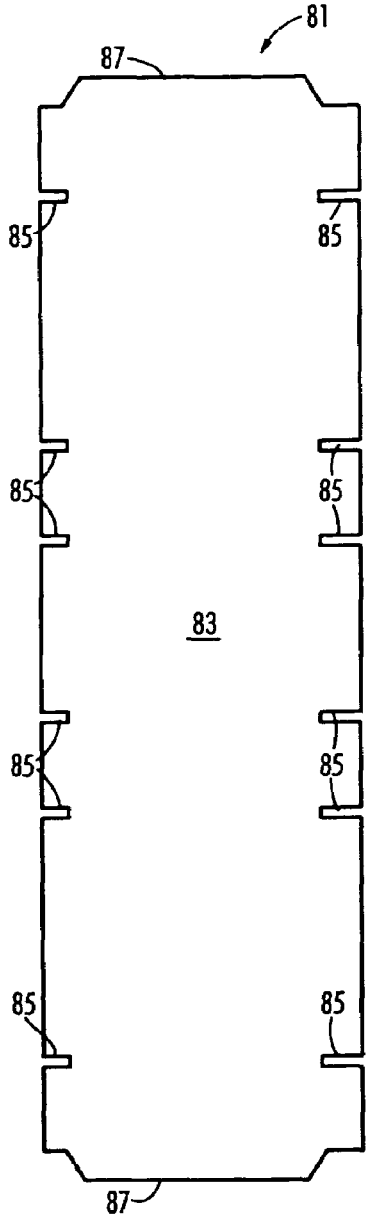
FIG. 6 is a stamped reinforcement sheet for use in combination with a stringer and cross-brace grid.
Figure 7A:
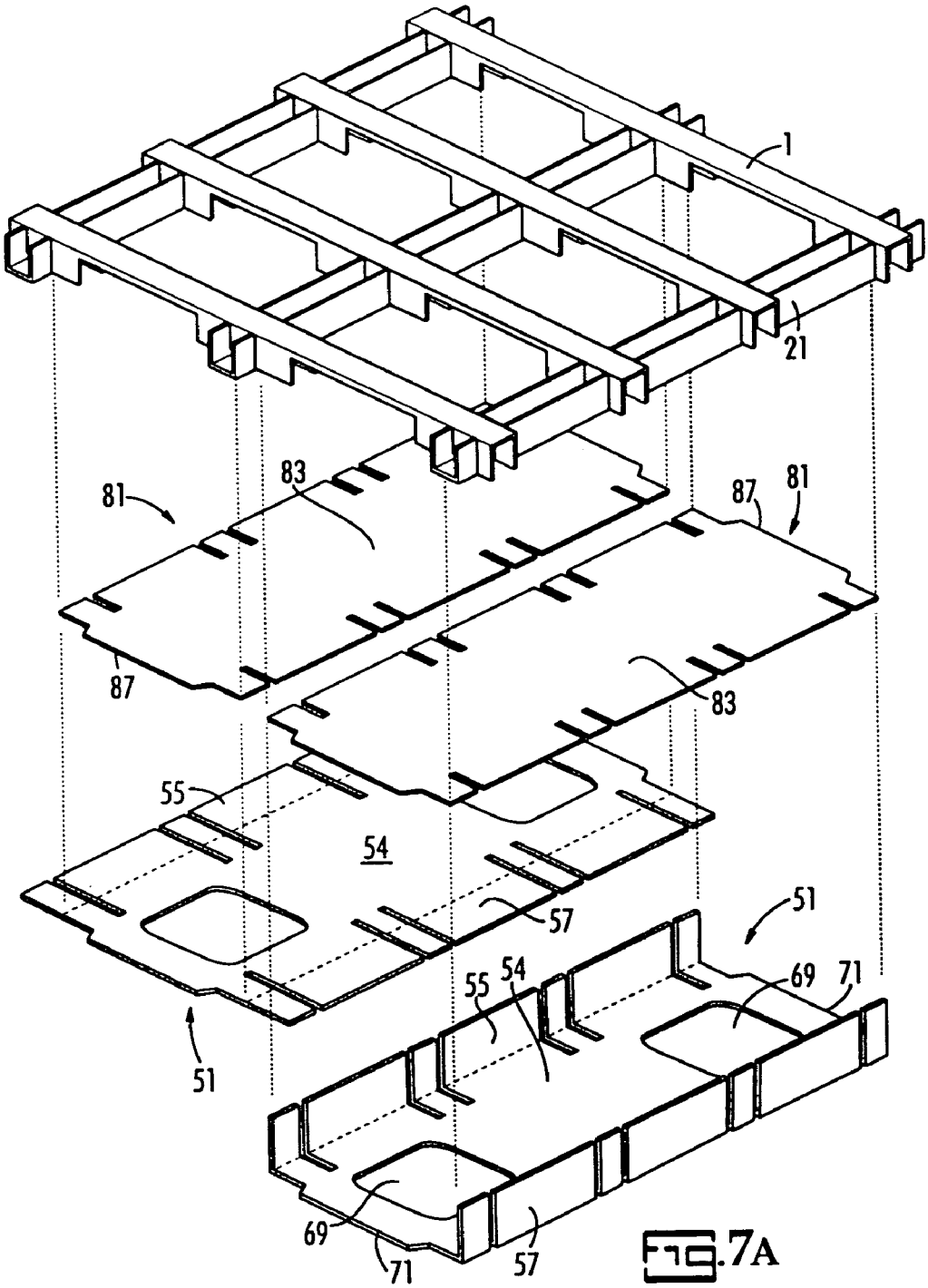
FIG. 7A is an exploded view of a pallet according to a second embodiment of the invention.
Figure 7B:
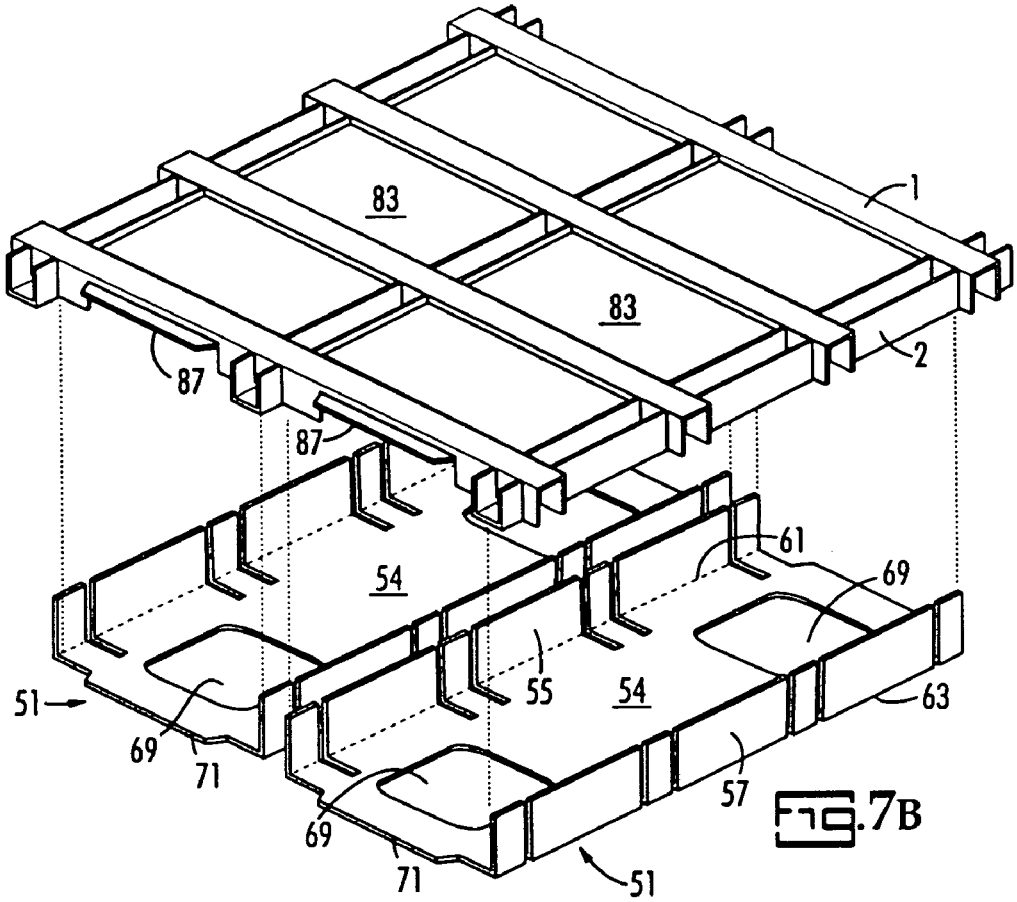
FIG. 7B is a partially assembled pallet according to the second embodiment.

FIG. 7A is an exploded view of how the reinforcement pieces for FIGS. 5 and 6 are assembled. Flat section 83 from FIG. 6 is pressed into position parallel to the stringer below the top of the flutes of stringer 21 and below cross-brace 1, with ends 87 projecting the full length of the stringers. The reinforcing pieces 51 are bent at creases 61, 63. The sections 55, 57 become additional flutes which reinforce stringers 21 and cross-braces 1, as shown in FIG. 7B.

Figure 7C:
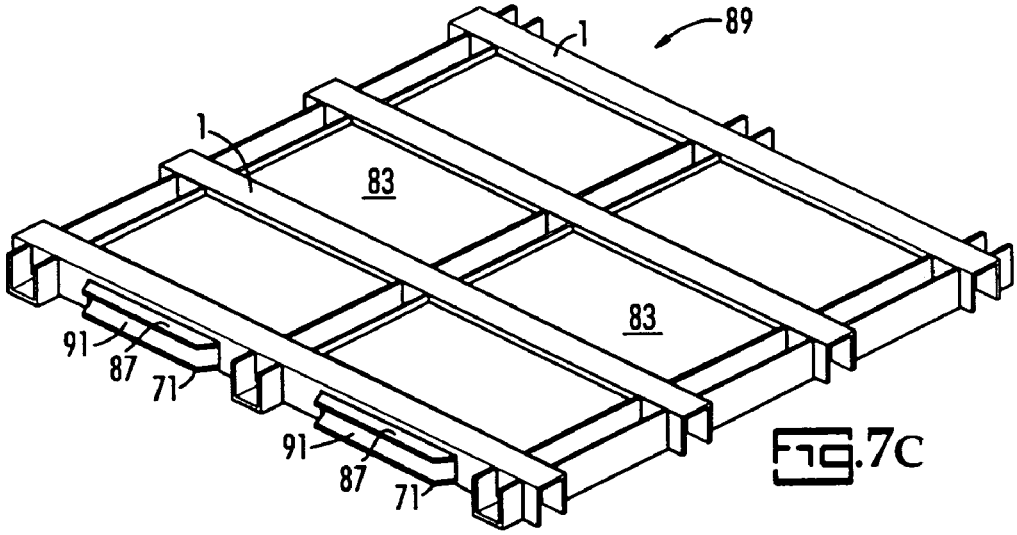
FIG. 7C is a completed support system for a second embodiment of the invention.

The assembled frameworks 89 is seen in FIG. 7C. The space between section 54 and section 83 is sufficient for form openings 91 which will accept the tines of a forklift. A deck in the form of a flat panel 29 and a floor in the form of a flat panel 31 then are adhered to the top and bottom of the framework 89 to complete the pallet. Pallets of this construction have been shown to support over 6,000 pounds (2700 kg).

In another embodiment, a tubular reinforcing is employed. In this embodiment, a separate flat panel base or floor is not required. In this embodiment, tines of a forklift may enter the pallet on all four sides.

Figure 8:
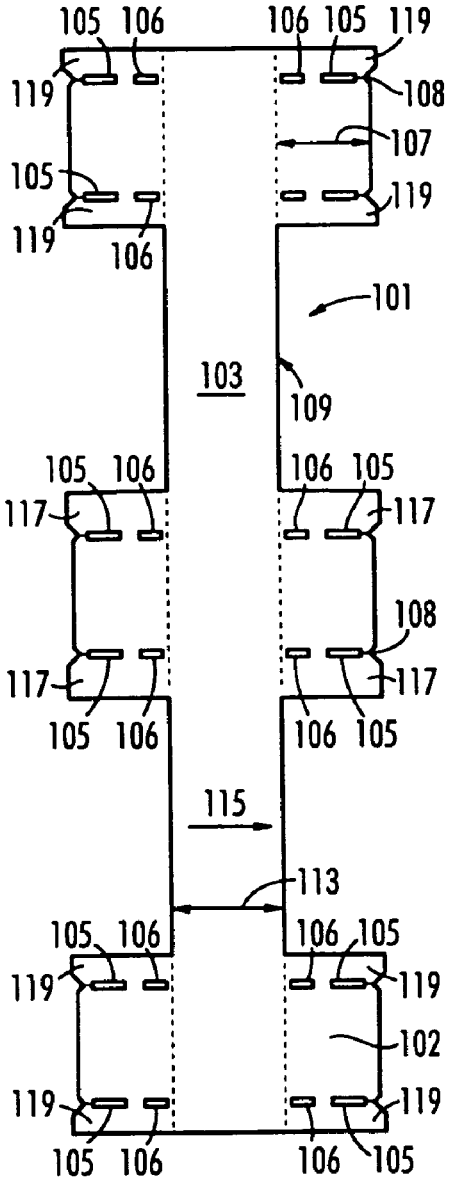
FIG. 8 shows a cross-brace for the support system for a second embodiment according to FIG. 7C.

FIG. 8 shows the first element of this embodiment, a cross-brace 101. The cross-brace is stamped from a blank 103. Slots 105 and 106 are formed in section 102, which ultimately becomes a flute. The length of the flute is limited at 107 to perfect interference with the stringer when assembled. Notched slots 108 assist in aligning tabs from the stringer, as will be described below. A deeper cut 109 provides space for passage of a tine. Crease line 111 is the fold line for forming flutes 102 and defines the width of the cross-brace as 113. The flute direction is 115.

Figure 9:
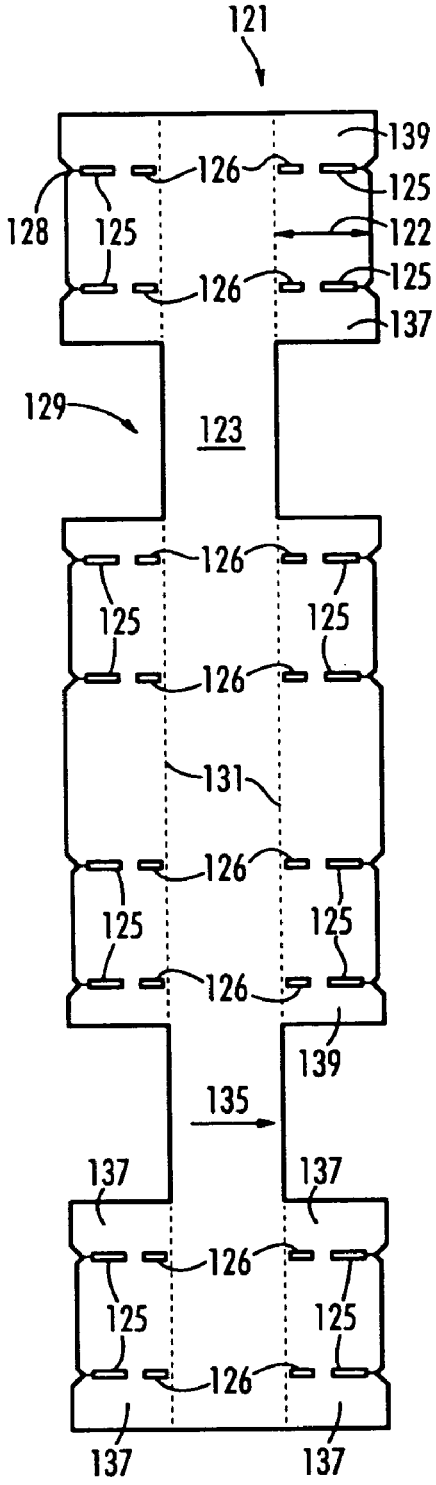
FIG. 9 shows a stringer for the second embodiment.

FIG. 9 shows the stringer 121 according to this embodiment. The blank 123 is stamped to from slots 125 and 126 to form flutes 122. The flute length is reduced at 127 to prevent interference with the cross-braces when assembled and notched slots 128 are made for ease of assembly in like manner as notches 108. Deeper cuts are made at 129 to provide for passage of tines. Crease line 131 is the fold line for forming flutes 122 and defines the width of the stringer as 131. The flute direction is 135.

It is noted that the stampings produce two distinct sets of tabs on both cross-brace and stringer, broad tabs 117 and 137 and narrow tabs 119 and 139. When assembled, it will be seen that these tabs insert into broad slots 105 and 125 and short slots 106 and 126.

Figure 10A:
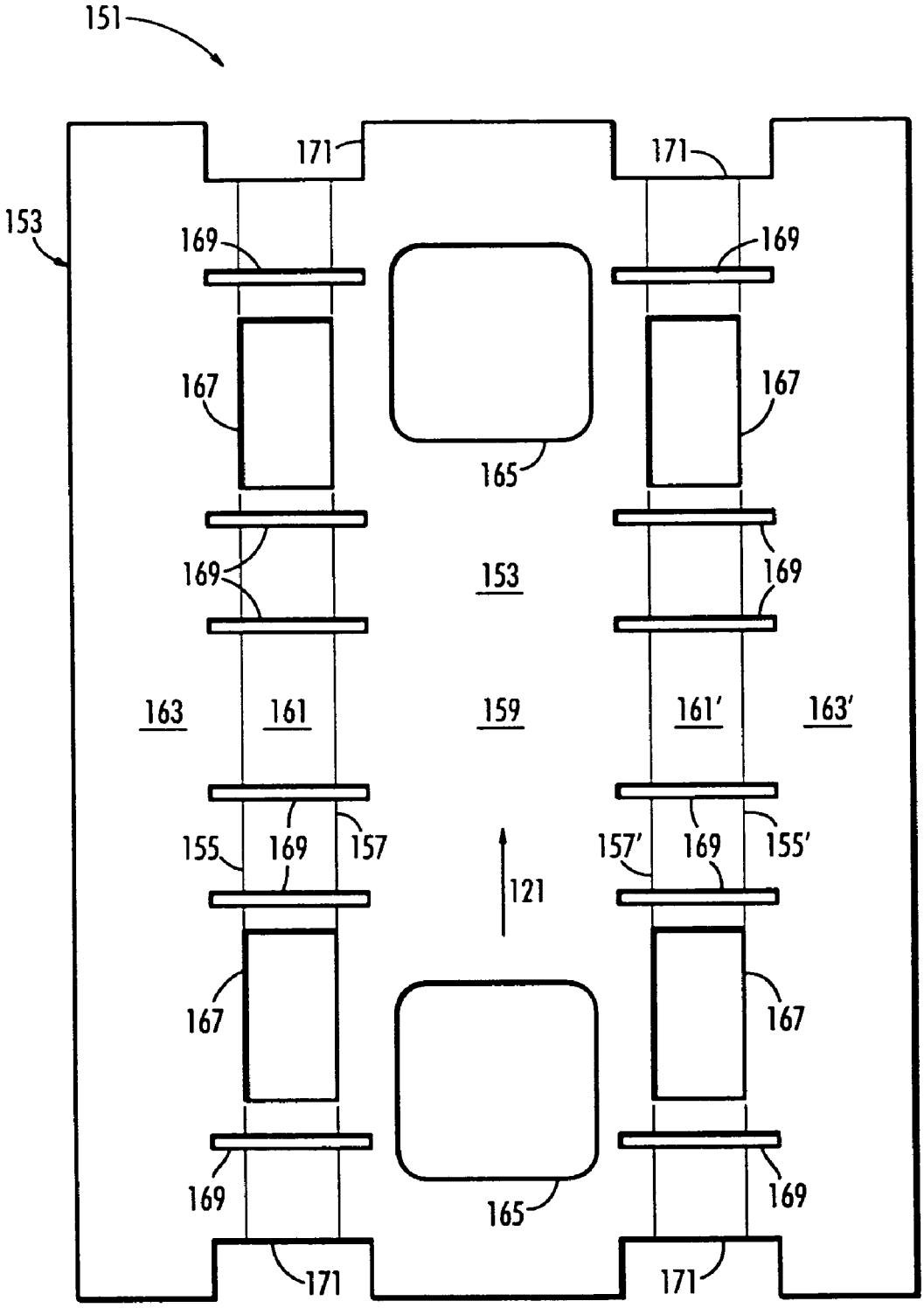
FIG. 10A shows a blank for a central brace for the second embodiment.
Figure 10B:
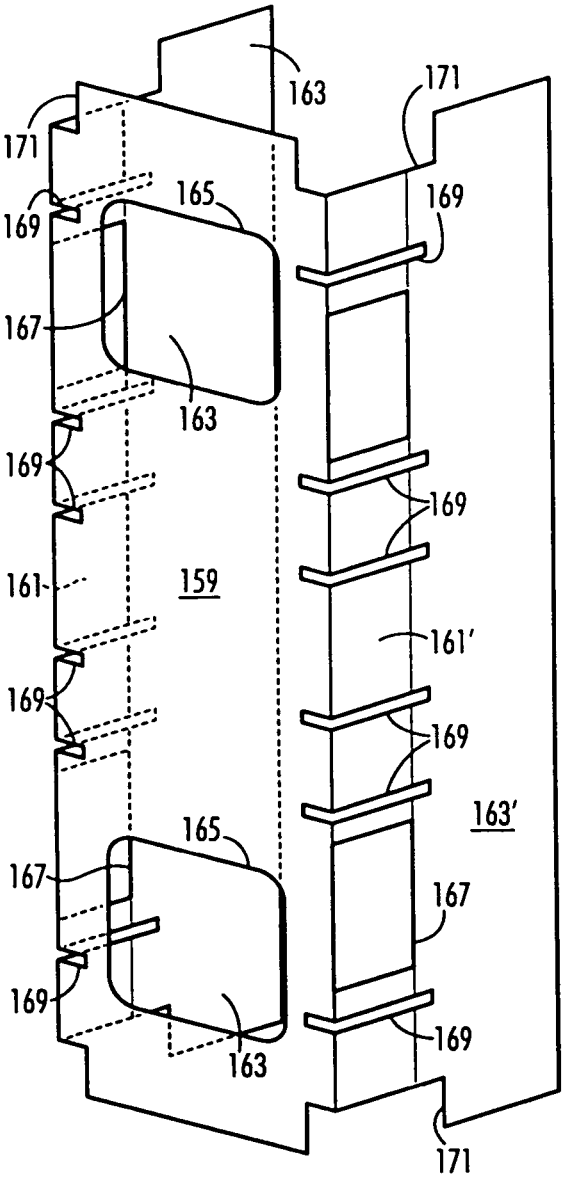
FIG. 10B shows the blank of FIG. 10A after a first fold sequence.
Figure 10C:
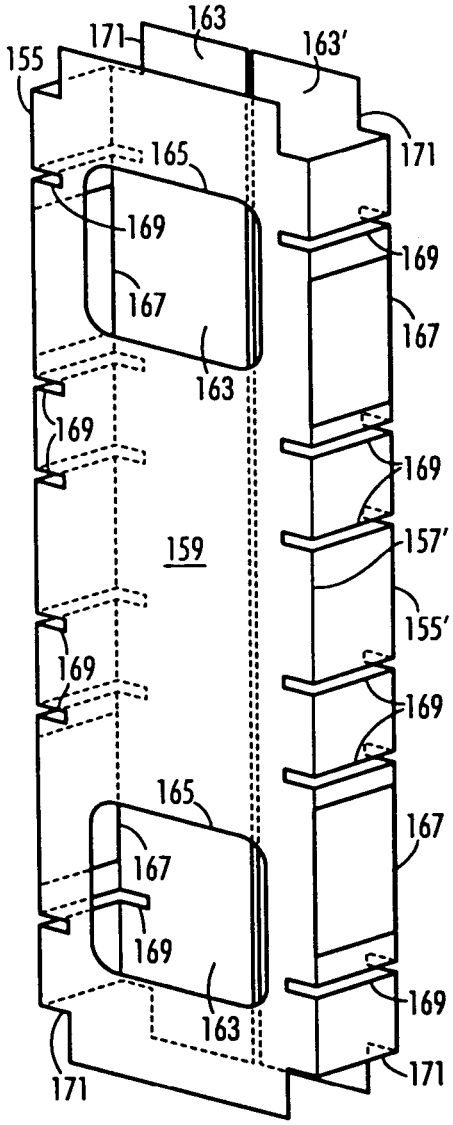
FIG. 10C shows the final fold to form the brace for the second embodiment.

FIG. 10 shows the third component of this embodiment, a central brace 151 which becomes a rectangular brace between stringers when assembly is completed. A blank 153 is created at fold lines 155, 155', 157 and 157' to form a central base 159, a pair of flute portions 161, 161' and a pair of top sections 163, 163'. Holes are cut at 165 for the wheels of a pallet truck. Tine clearance is provided at 167. Clearance for flutes 102 is provided by cuts at 169 and 171.

The fourth component is flat panel 181 which forms the top surface of the pallet.

When the pallet is built the preferred method is to first assemble the cross-braces and stringers. A jig is used to hold one component, usually the stringers which have been folded along creases 131 to form flutes 122. The cross-braces are folded along creases 111 to form flute 102 when pressed together, the tabs formed by cut 108 slides into slots 126 and the tab formed by slit 128 fits into slot 106. For a full size pallet, three stringers and four cross-braces are used.

Next the central brace is folded along crease lines 155, 155', 157 and 157' to form a rectangular tube along the 121 direction and is pressed between the stringers. Slot 169 accepts the flange formed between slots 105 and 106 and the end of the cross-brace or the flange formed between slots 105 and 106 and the cut-out 109.

Figure 11A:
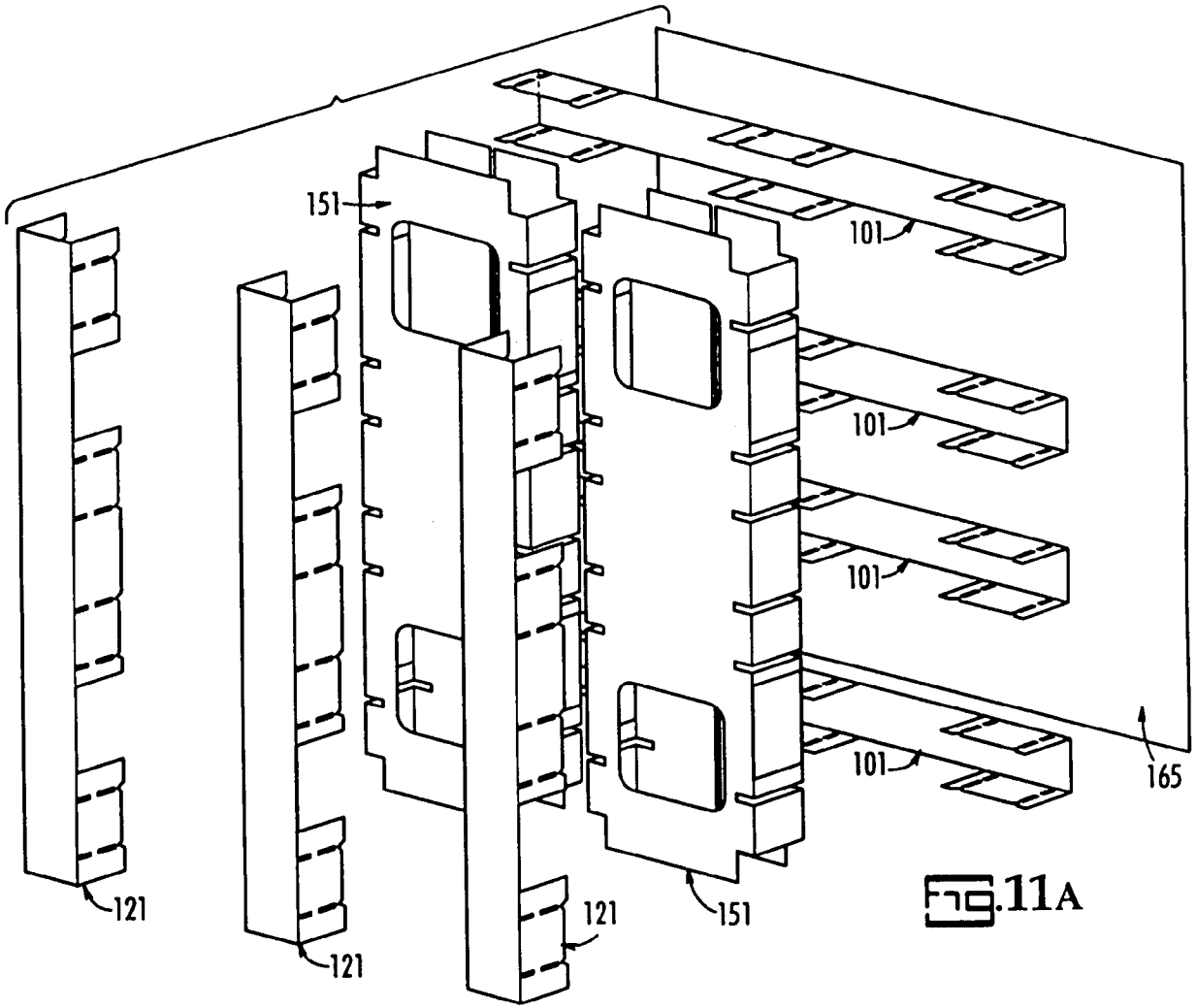
FIG. 11A is an exploded view of a central brace.
Figure 11B:
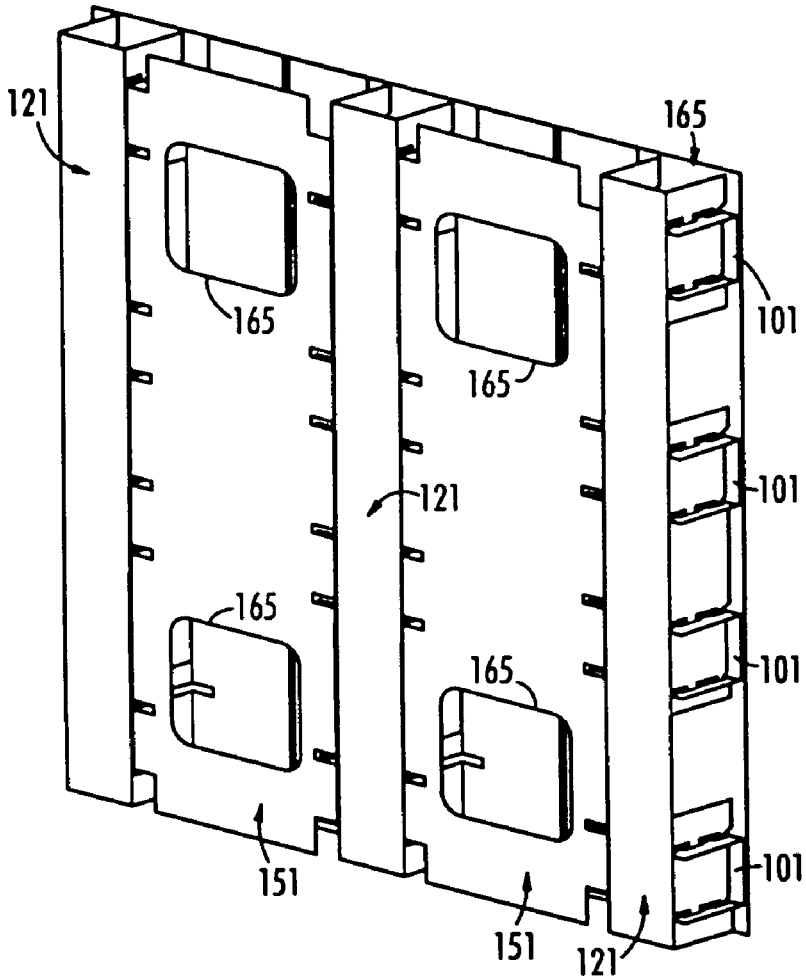
FIG. 11B illustrates the assembled brace.
Figure 12A:
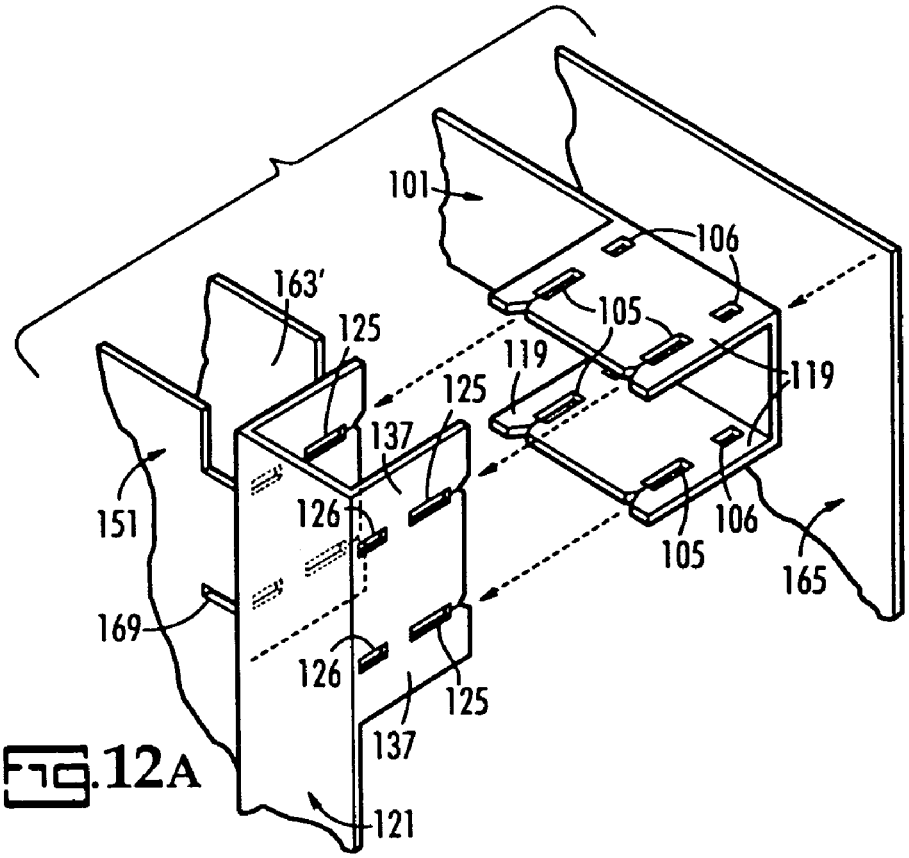
FIGS. 12A and 12B are details of the fitment of the stringer and central brace.
Figure 12B:
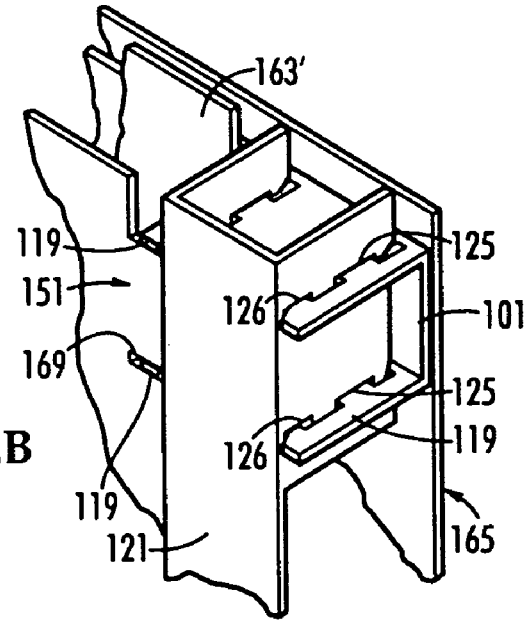

After the cross-braces are assembled and prior to insertion of the central brace, it is preferred to spray surfaces of the cross-braces and stringers which will contact the central brace with a fast-drying adhesive. When assembled, as shown in FIG. 11, the central base 151 is flush with the exposed surface 123 of the stringers and the folded tops 163, 163' abut in contact with the (reverse) face of stringer 103. The top surface of cross-braces 101 and tops 163, 163' is sprayed with adhesive and top surface 165 is applied. The detail of how the cross-braces stringers and central brace are fitted is shown in FIGS. 12A and 12B.

The invention has been described in terms of preferred embodiments, which are exemplary but not limitative of the invention. Modifications apparent to a person of skill in the art are subsumed within the purview of the invention.

For recycling, the pallets may be crushed, shredded or otherwise modified for ease of shipment to a recycling plant.

INDUSTRIAL UTILITY

The corrugated pallets of this invention are easily shipped to a user in knock-down form for on-site assembly. The pallets are easily recycled and more economical than wood or plastic alternatives, especially for international commerce.

This invention has been described in terms of the preferred embodiment. Modifications and additions obvious to those skilled in the art are included within the sprit and scope of the invention.

I claim:

1. A corrugated box structure useful as a pallet comprising:

a) at least two stringers;

b) at least two cross-braces;

c) a flat corrugated top, and d) a flat corrugated bottom;

wherein said stringers interdigitate with said cross-braces to interlock the stringers and cross-braces together before said top and said bottom are adhered in place, said box structure further comprising a first reinforcement section having a lone axis and flutes parallel to said stringers and interdigitating with the flutes of said cross-braces so as to reinforce said corrugated bottom; and a second reinforcement section having a long axis parallel to said stringers, interdigitating with the flutes of said cross-braces and positioned to be in contact with the cross-braces to support said flat corrugated top.

2. A corrugated box structure according to claim 1 wherein said stringers and said cross-braces are cut from individual corrugated sheets and folded to align flutes of the corrugated sheets in the vertical direction.

3. A corrugated box structure according to claim 1 which consists of flat precut sheets of corrugated paper which have been pre-cut for folding and which are shipped flat to a user for assembly.

4. A corrugated box structure according to claim 1, wherein said cross-braces have cut out portions which allow the tines of a fork lift to pass through channels in a pallet.

5. A corrugated box structure according to claim 1 wherein said flat corrugated bottom has multiple cut-outs to accommodate the passage of load wheels of a pallet truck.

6. A corrugated structure according to claim 1 wherein said first reinforcement section has multiple cut-outs to accommodate the load wheels of a pallet truck.

* * * * *